US008492984B2

(12) United States Patent
Deurenberg et al.

(10) Patent No.: US 8,492,984 B2
(45) Date of Patent: Jul. 23, 2013

(54) DIMMER CONTROL CIRCUIT FOR SELECTING BETWEEN STEP DIMMING MODE AND PHASE-CUT DIMMING MODE

(75) Inventors: Peter Hubertus Franciscus Deurenberg, S-Hertogenbosch (NL); Wilhelmus Hinderikus Maria Langeslag, Wijchen (NL); Henricus T. P. J. van Elk, Ravenstein (NL); Frank van Rens, Horst (NL)

(73) Assignee: NXP B.V., Eindhoven (NL)

( * ) Notice: Subject to any disclaimer, the term of this patent is extended or adjusted under 35 U.S.C. 154(b) by 220 days.

(21) Appl. No.: 13/147,016

(22) PCT Filed: Feb. 1, 2010

(86) PCT No.: PCT/IB2010/050432

§ 371 (c)(1),
(2), (4) Date: Jul. 29, 2011

(87) PCT Pub. No.: WO2010/086835

PCT Pub. Date: Aug. 5, 2010

(65) Prior Publication Data

US 2011/0285303 A1 Nov. 24, 2011

(30) Foreign Application Priority Data

Feb. 2, 2009 (EP) ..... 09100090

(51) Int. Cl.
*H05B 37/02* (2006.01)

(52) U.S. Cl.
USPC ..... 315/209 R; 315/291

(58) Field of Classification Search
None
See application file for complete search history.

(56) References Cited

U.S. PATENT DOCUMENTS

| | | | | |
|---|---|---|---|---|
| 5,691,605 | A | 11/1997 | Xia et al. | |
| 2002/0060537 | A1 * | 5/2002 | Lee et al. | 315/DIG. 4 |
| 2008/0106216 | A1 * | 5/2008 | Yu et al. | 315/247 |
| 2011/0025228 | A1 | 2/2011 | Van Elk et al. | |

FOREIGN PATENT DOCUMENTS

| | | | |
|---|---|---|---|
| EP | 1 725 085 | A1 | 11/2006 |
| EP | 2 106 203 | A2 | 9/2009 |
| JP | 2002-329586 | A | 11/2002 |

OTHER PUBLICATIONS

International Search Report and Written Opinion for Int'l. Patent Appln. No. PCT/IB2010/050432 (May 25, 2010).

* cited by examiner

*Primary Examiner* — Crystal L Hammond

(57) ABSTRACT

The present invention relates to a dimmer control circuit (100) capable to detect whether a phase-cut dimmer is connected using an average signal (VDCI) derived from the mains voltage. The average signal (VDCI) or a signal (VDCI_ls) derived from (VDCI), ranging from a minimum value to a maximum value, is compared to a dimming threshold (Vdim_th) through a phase-cut detecting unit (20). The comparison result is used to control the state diagram of a dimmer control logic (40) by selecting the step dimming mode (STD) or the phase-cut dimming mode (PCD). The output (OUT) of a switching unit (30) is determined by the state diagram of the dimmer control logic (40) in such a manner that the phase-cut dimming mode (PCD) is prioritized above the step-dimming mode (STD) and the maximum level of the STD states is depending on the mains voltage and application adjustable.

19 Claims, 7 Drawing Sheets

DIMMER CONTROL CIRCUIT FOR SELECTING BETWEEN STEP DIMMING MODE AND PHASE-CUT DIMMING MODE

FIELD OF THE INVENTION

The present invention relates to the field of lighting devices, and more particularly to a light-dimming detection circuit.

BACKGROUND OF THE INVENTION

Due to the world-wide increasing focus on energy consumption, more and more attention is paid to lamps commonly referred to as "energy saving" lamps, such as Compact Fluorescent Lamps (CFL), which are energy efficient by consuming up to five times less energy than the conventional incandescent lamps.

However, due to the electrical nature of both the phase-cut dimmers and the CFL circuits, they do not work together as well as the incandescent lamps and dimmers. Moreover, some people do not have phase-cut dimmers installed. Although installing a phase-cut dimmer is not very complicated, many people hesitate to install one because of the dangerously high mains voltage.

The solution would be to have a lamp that is always dimmable by selecting either phase-cut dimming or step dimming, knowing that an end user will be able to step dim with a phase-cut dimmer, although not logical.

At this respect, EP08103192.4 discloses a waveform detection circuit for a CFL controller adapted to detect a rectified phase-cut or sinusoidal waveform using its duty cycle and in response, to select the respective dim mode amongst the linear phase-cut dimming and the step dimming, the latter being defined by several fixed values at a mains voltage independent level. The duty cycle is determined based on the fact that the phase-cut dimmers always cut off at least some part of the sinusoid of the mains voltage, as it is illustrated in FIG. 1 depicting conventional AC mains supplied waveforms without (A-sinusoidal waveform) and with phase-cut dimming (B-forward phase-cut waveform and C-reverse phase-cut waveform). However, it may turn out that phase-cut dimmers connected to CFL driver circuits do not produce such perfect waveforms, and in particular that the cut-off part does not drop to zero very fast. Thus, in addition to the phase detection circuitry, supplemental circuitry might be needed to create the required cut-off curves, thereby rendering the circuitry quite complex.

SUMMARY OF THE INVENTION

It is therefore an object of the present invention to provide for a simple dimmer control circuit adapted to auto-detect between step dimming and phase-cut dimming using an average signal, and to prioritize phase-cut dimming above step dimming when a phase-cut dimmer is connected.

This object is achieved by a dimmer control circuit as claimed in claim 1, a control circuit for controlling a lamp as claimed in claim 13, a method as claimed in claim 16, a computer program as claimed in claim 17, and an integrated circuit as claimed in claims 18 and 20.

In accordance with the present invention, there is provided a dimmer control circuit comprising:

a dimmer control logic;

a comparator for comparing a signal derived from the mains voltage to a reference value, the comparison result being used for selecting between a step dimming mode and a phase-cut dimming mode of the dimmer control logic;

a switching unit, the switching sequence of the switching unit being controlled by the dimmer control logic based on the selection in order to switch between one amongst a plurality of values;

wherein, the phase-cut dimming mode is prioritized above the step dimming mode when a phase-cut dimmer is connected; and the maximum level of the step dimming mode is depending on the mains voltage and application adjustable.

Thereby, the maximum level of the step dimming mode cannot be fixed at a mains voltage independent level, and the level of light can be more precisely set by an end user by prioritizing the phase-cut dimming mode above the step dimming mode when a phase-cut dimmer is connected.

The dimmer control logic may switch from the step dimming mode to the phase-cut dimming mode when the signal is lower than the reference value. Thereby, the prioritization can be defined and safety can be realized in high power situations with low input voltage since the lamp to be controlled using the dimmer control circuit can be prevented from drawing a lot of power while being phase-cut dimmed to a low RMS mains voltage.

The dimmer control logic may switch between a plurality of step dimming states of the step dimming mode by toggling the mains voltage when the signal is greater than the reference value. Thereby, the useful range of phase-cut dimmers will not be reduced by a threshold, i.e. the reference value, under which phase-cut dimming is active.

The maximum level of the step dimming mode may be equal to the level of the phase-cut dimming mode when the signal is greater than the reference value. Thereby, the step dimming mode and the phase-cut dimming mode can have the same level (which is depending on the mains voltage and application adjustable) when the signal is above the dimming threshold, which can allow the dimming range of phase-cut dimmers to be not reduced by such a threshold, under which phase-cut dimming is active. Thus, the light output level can change when the reference value is exceeded in order to prevent reduction of the dimming range of the phase-cut dimmer.

The switch of the dimmer control logic from any step dimming state below maximum to the phase-cut dimming state is performed after initiating a reset of the dimmer control logic. Thereby, the behaviour of the lamp under control in terms of light output can be controlled by the end user. The reset may be initiated when the signal becomes greater than the reference value under which the signal has dropped earlier.

The reset may occur in the normal operating state, which is defined as the operating state of the system after the initial start-up sequence of the lamp under control. Thereby, the step dimming behaviour can be as required. Indeed, resetting beyond the normal operating state would yield to undesired resets, blocking the required step dimming behaviour.

The dimmer control logic may further comprise a converter, the signal being a signal converted by the converter. Thereby, the level of the input signal of the dimmer control logic can be adjusted to different levels.

The converter may be a level shifting down unit. Thereby, the level of the input signal of the dimmer control logic can be reduced, and the corresponding dimming curve can be adjusted after level shifting to the actual phase-cut range $\delta$ of the phase-cut dimmers, i.e. from 0° until 120°.

The signal may be an average signal. Thereby, the detection of a phase-cut dimmer is not dependent on the AC mains voltage supplied waveforms and on the detection of the phase or the duty cycle of these waveforms.

The average signal may be obtained by rectifying, attenuating, and integrating the mains voltage. Thereby, the average signal can be easily obtained through a simple appropriate circuit, such that it is not needed to use a complex circuit for detecting the phase or the duty cycle and creating cut-off curves, such as the forward and reverse phase-cut waveforms, dropping very fast to zero.

The switching unit and the dimmer control logic may be part of a multiplexer.

In accordance with the present invention, there is also provided a control circuit for controlling a lamp, the control circuit comprising at least the aforementioned dimmer control circuit.

The plurality of values may be used to set the light level of the lamp under control.

The lamp under control may be specified to be either a compact fluorescent lamp, a tube lamp, a high intensity discharge lighting, or a solid state lighting. Thereby, applications contemplated for such dimmer control circuit include the control of not only compact fluorescent lamps, but also the control of other dimmable lamps.

In accordance with the present invention, there is provided a method of auto-detecting between a step dimming mode and a phase-cut dimming mode, the method comprising:

comparing a signal derived from the mains voltage to a reference value;

selecting between the step dimming mode and the phase-cut dimming mode of a dimmer control logic based on the comparison result;

controlling a switching unit by the dimmer control logic based on the selection in order to switch between one amongst a plurality of values;

wherein, the phase-cut dimming mode is prioritized above the step dimming mode when a phase-cut dimmer is connected; and the maximum level of the step dimming mode is depending on the mains voltage and application adjustable.

Finally, it is worth to be noted that since it is apparent to the person skilled that voltage references and current references may be considered in an analogue or alternative manner, the foregoing discussion and description should be understood to cover both, i.e. embodiments in which current references are used and embodiments in which voltage references are used.

The steps of the previous method can be carried out by a computer program including program code means, when the computer program is carried out on a computer.

The present invention further extends to an integrated circuit comprising the dimmer control circuit, which in certain embodiments comprising a digital core adapted to carry out the above mentioned computer program, which computer program can be implemented in a flexible (i.e. changeable or reprogrammable) or fixed (i.e. hard wired) manner by said digital core. The present invention furthermore extends to another integrated circuit comprising the control circuit which in particular embodiments may be implemented as a digital core adapted to carry out the above mentioned computer program, which computer program can be implemented by said digital core in a flexible (i.e. changeable or reprogrammable) or fixed (i.e. hard wired) manner.

BRIEF DESCRIPTION OF THE DRAWINGS

These and other aspects and advantages of the present invention will be apparent from and elucidated with reference to the embodiment(s) described hereinafter. In the following drawings.

DETAILED DESCRIPTION OF EMBODIMENTS

As general remark, since voltage references and current references may be considered in an analogue or alternative manner, the following discussion and description of embodiments should be understood to cover both also the use of current references, even that herein only voltage references are described. Thus, the following embodiments do not intend to limit the scope of the invention, by only describing the use of voltage references.

Figure 1:
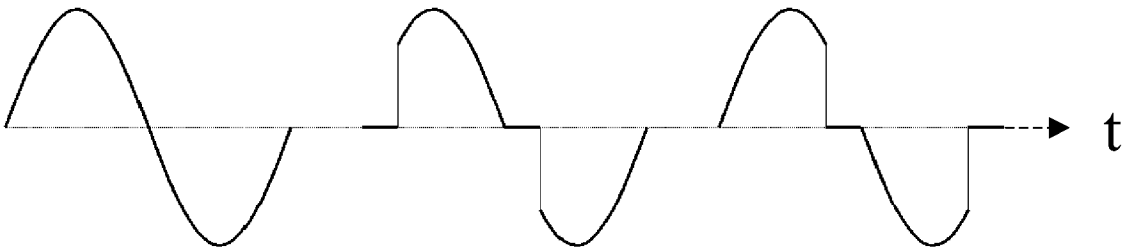
FIG. 1 shows conventional AC mains voltage supplied waveforms without phase-cut dimming (A-sinusoidal waveform) and with phase-cut dimming (B-forward phase-cut waveform and C-reverse phase-cut waveform)
Figure 2:
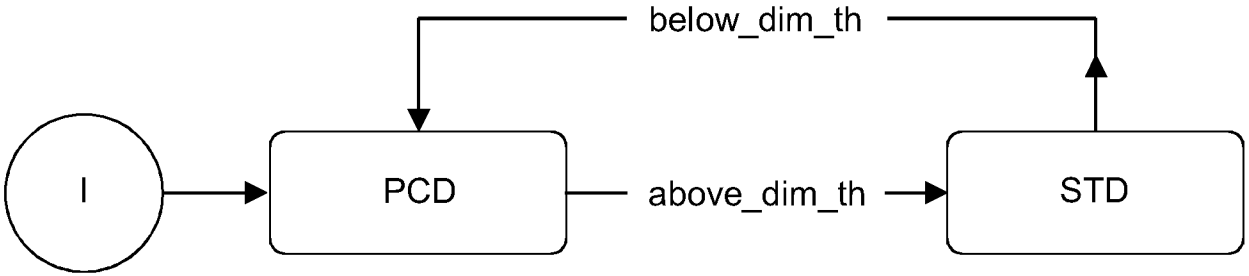
FIG. 2 shows the two operating modes of a dimmer control circuit and transitions between each mode: a phase-cut dimming mode (PCD) and a step dimming mode (STD), according to the present invention.

FIG. 2 shows the two operating modes of a dimmer control circuit, i.e. the phase cut dimming mode (PCD) and the step dimming mode (STD), and the transitions between both modes. It shows that the phase-cut dimming mode (PCD) is used by default through initialization (I). Shown by the above_dim_th arrow, the step dimming mode (STD) will be activated when the phase-cut dimmer is tuned towards high dimming levels above a dimming threshold, set close to its maximum output. If the connected phase-cut dimmer is tuned towards deeper dimming levels, while being set below the aforementioned dimming threshold, the phase-cut dimming mode (PCD) will always be activated, as indicated by the below_dim_th arrow. Thereby, phase-cut dimming can be prioritized above step dimming, which allows an end user to set a more precise level of light, and safety can be realized in high power situations with low input voltage, since the lamp to be controlled is then prevented from drawing a lot of power while being phase-cut dimmed to a low RMS mains voltage.

In the particular case that the phase-cut dimming mode (PCD) is active and the connected phase-cut dimmer is tuned towards higher dimming levels set above the aforementioned dimming threshold, it is important that the light output level can change in order to avoid reduction in the dimming range of the phase-cut dimmer as is the case when the 100% step dimming level is fixed at a mains voltage independent level. To prevent this, the 100% step dimming level needs to be the same as the phase-cut dimming level, which depends on the mains voltage and can be application adjustable. Consequently, the step dimming mode (STD) should consist of at least two levels (states), where one is as just described. This is depicted in the state diagram of FIG. 3, where the details of the step dimming mode are shown.

Figure 3:
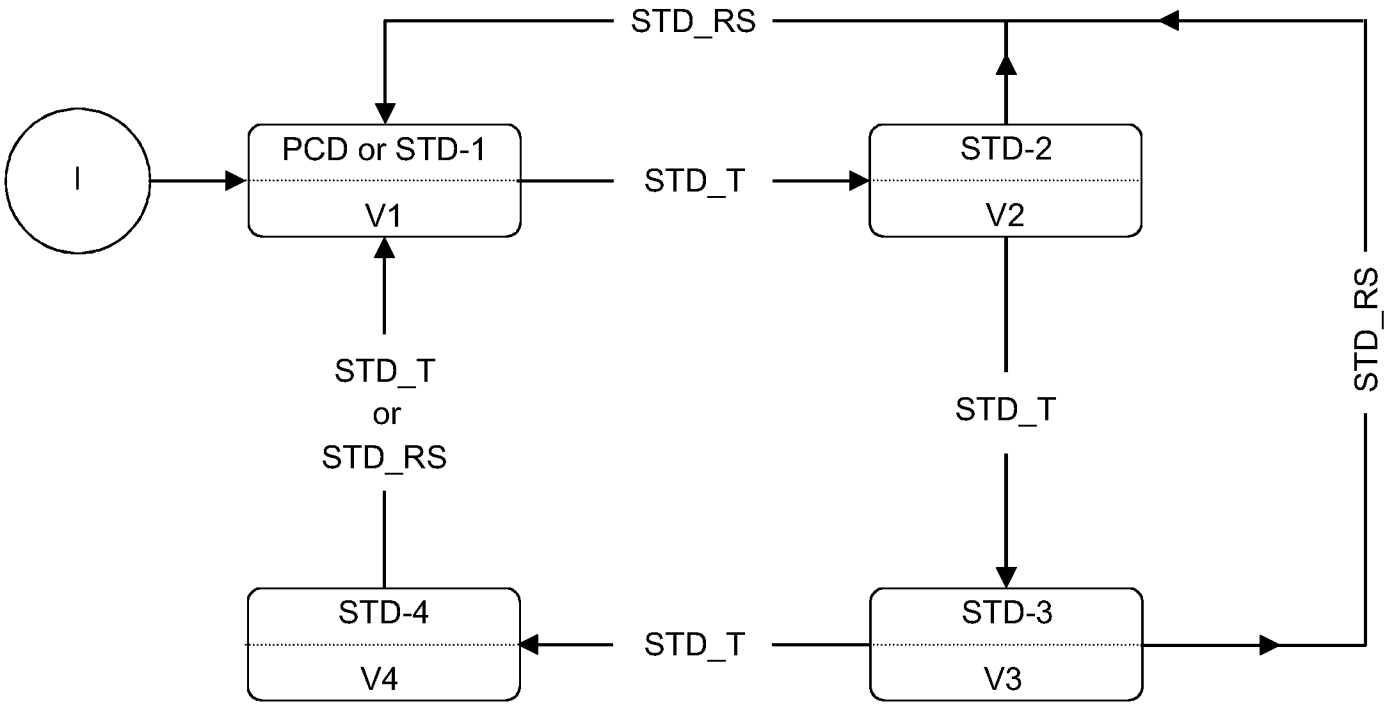
FIG. 3 shows the detailed state diagram of the step dimming mode.

Such a state diagram for combined step dimming and phase-cut dimming shows that the phase-cut dimming state (PCD) is used by default through initialization (I). If the connected phase-cut dimmer is tuned towards high dimming levels set above the dimming threshold and close to its maximum output, e.g. 100% light output, the dimming level can step dim from the V1 level above the dimming threshold, i.e. the same level as the phase-cut dimming level which is set in our example to 100% light output (PCD state or STD-1 state), to V2 level, e.g. 50% light output (STD-2 state), by toggling the mains (STD_T or STD_TOGGLE). Then, by toggling each time the mains (STD_T or STD_TOGGLE), the dimming level can step dim from V2 level to V3 level, e.g. 25% light output (STD-3 state), from V3 level to V4 level, e.g. a minimum dim level MDL set to 10% light output (STD-4 state) and from V4 level to V1 level, respectively. These mains toggles are identified by the supply voltage (VS) dropping below the VSreset level, which is defined as the level of VS upon which the lamp controller will reset all states except of the step dimming state machine, and the lamp control entering the normal operating state (NOS) again, which NOS being defined as the operating state of the system after the initial start-up sequence of the lamp under control. It is to be noted that only a single transition will be made and the step dimming state will be determined by the number of mains toggles. If the connected phase-cut dimmer is tuned towards deeper dimming levels set below the dimming threshold while the step dimming mode (STD) is active (FIG. 2) in either one of the step dimming states STD-1, STD-2, STD-3, STD-4, the phase-cut dimming mode (PCD) is then automatically activated, as indicated in FIG. 3.

Figure 4:
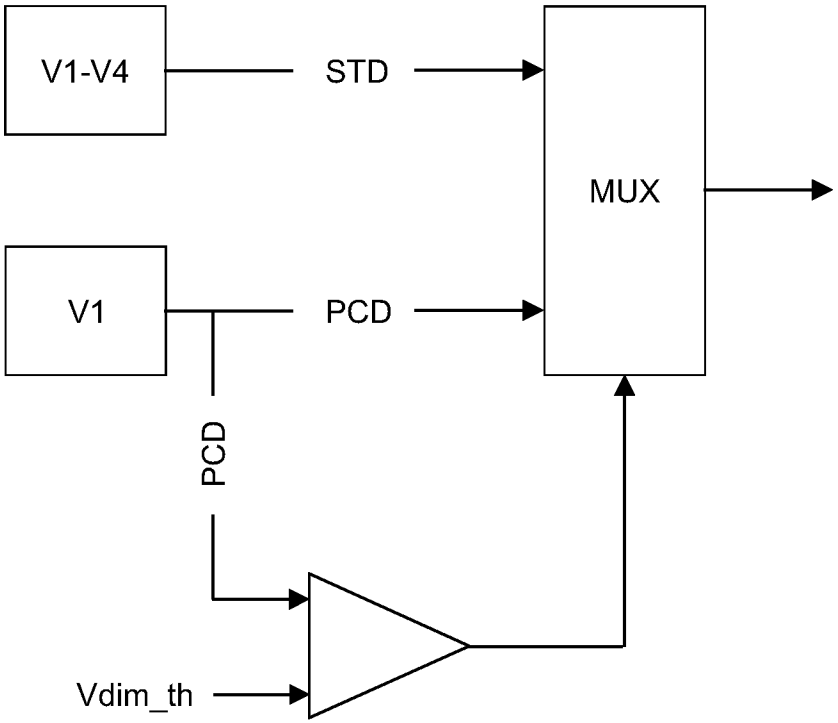
FIG. 4 shows a multiplexer for switching between the phase-cut dimming mode (PCD) and the step dimming mode (STD) according to an embodiment of the present invention.

As depicted in FIG. 4, a multiplexer (MUX) can be used for switching between the step dimming mode (STD) at one of the levels V1-V4 and the phase-cut dimming mode (PCD) at the V1 level, based on the aforementioned dimming threshold, designated as Vdim_th in FIG. 4. A comparator (indicated by a triangle) can compare the level V1 of the PCD state and the dimming threshold (Vdim_th), and the comparison result can then be used to control the selection of the multiplexer (MUX) between the PCD state and a STD state. Thus, the multiplexer (MUX) will select a STD state (V1-V4) when the level V1 is above the dimming threshold (Vdim_th) and the PCD state when the level V1 is below the dimming threshold (Vdim_th).

In the particular case that an end user decides to change from the step dimming mode (STD), e.g. the STD-3 state at 25% light output, to the phase-cut dimming mode (PCD) by turning the connected phase-cut dimmer towards lower dimming levels set below the dimming threshold Vdim_th, the switch to the phase-cut dimming mode (PCD) will occur but without resetting the step dimming state machine (FIG. 3), i.e. the STD-3 state at 25% light output in our example. However, if the end user subsequently decides to turn the connected phase-cut dimmer towards higher dimming levels set above the dimming threshold Vdim_th, the reset (RS) of the step dimming state machine (STD_RS in FIG. 3) to the PCD state will occur. Indeed, it is important that the lamp under control does not switch back to the previous STD state, i.e. the STD-3 state at 25% light output in our example, because this may lead to an unexpected behaviour of the lamp if the end user had the intention of increasing the light output from 25% to 90% for example. In order to avoid such issue, the step dimming state machine is reset (STD_RS).

Figure 5:
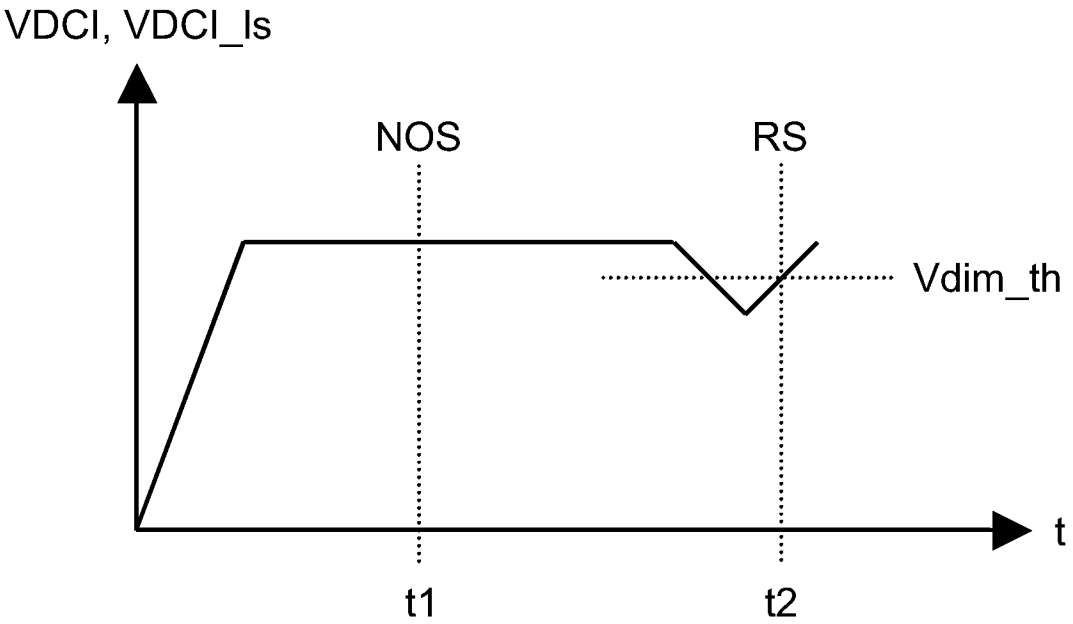
FIG. 5 shows a graph depicting the dimmer control input (VDCI) voltage or a voltage (VDCI_ls) derived from VDCI versus time t, and in particular the instant of reset (RS) occurrence for the state machine of the multiplexer of FIG. 4.

The reset (RS) can be initiated by generating a STD_RS (or STD_RESET) trigger before a switch is made to the STD state (FIG. 2). The reset will occur only in the normal operating state (NOS) at the moment when the dimmer control input (DCI) voltage (VDCI) or a voltage (VDCI_ls) derived from VDCI rises again above the dimming threshold Vdim_th under which it has dropped earlier. This is illustrated in the diagram of FIG. 5 showing the shape of VDCI or VDCI_ls versus time t, wherein t1 represents the instant when the NOS is entered and t2 represents the instant when the reset (RS) occurs, i.e. the instant when the reset (RS) pulse starts. Resetting beyond the normal operating state (NOS) would yield to undesired resets, blocking the required step dimming behaviour.

It is to be noted that a small and short light increase might occur when toggling. Indeed, when the end user toggles the mains (STD_T or STD_TOGGLE), the mains voltage is interrupted, i.e. turned off, and this may cause the VDCI or VDCI_ls voltage and the supply voltage (VS) of the lamp controller to drop. Thus, the light increase can happen when VDCI or VDCI_ls drops faster than VS. At some point, VDCI or VDCI_ls will drop below the dimming threshold Vdim_th, upon which it will (temporarily) switch to the PCD state, where a short while later the lamp will switch off because VS drops below VSstop, which is defined as the level of VS upon which the lamp controller will stop switching the lamp. However, this cannot be seen as an issue since turning off the lamp will result in a steep light output change anyhow.

Figure 6:
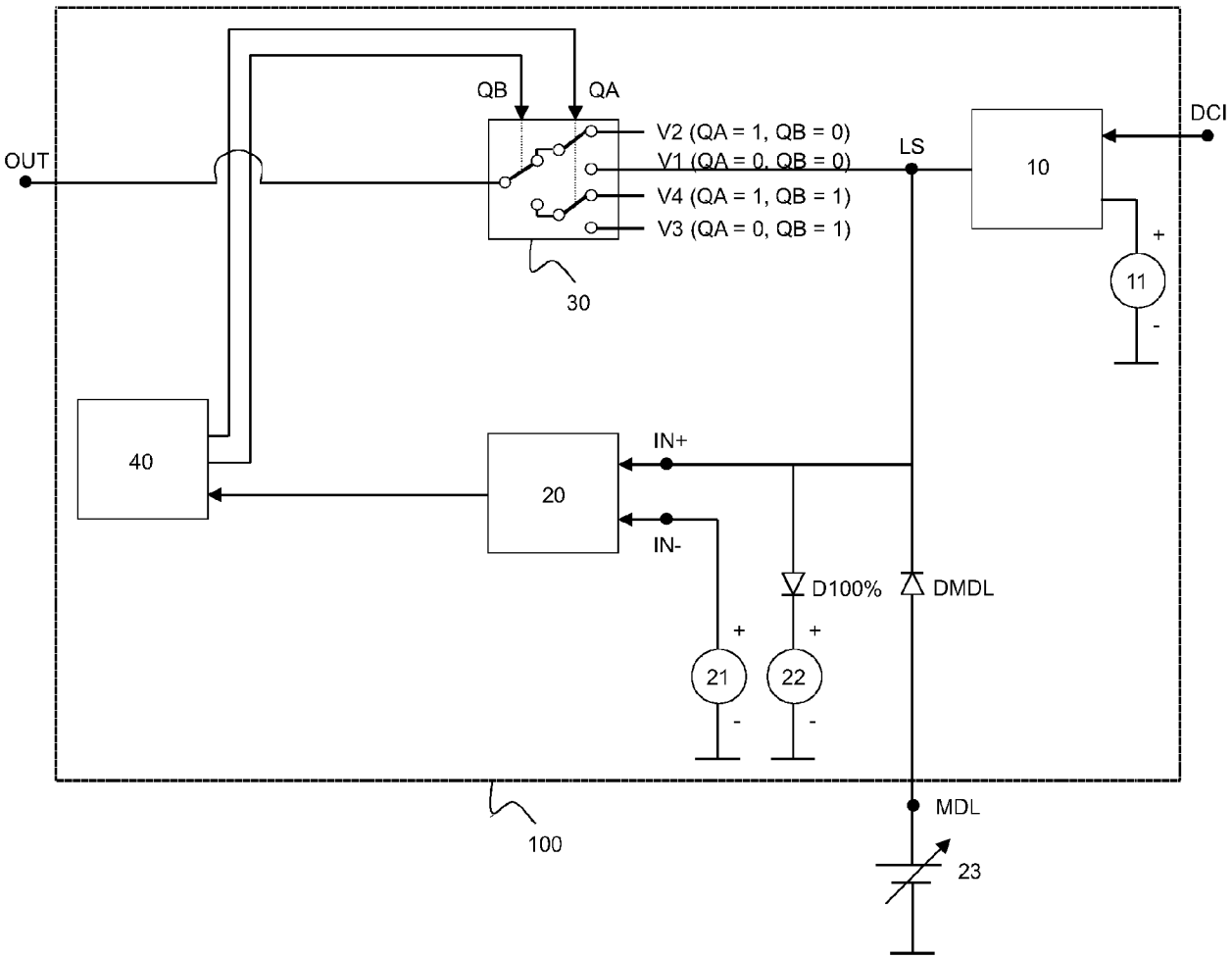
FIG. 6 shows a schematic diagram of a dimmer control circuit 100 according to an embodiment of the present invention.

FIG. 6 illustrates a schematic diagram of a dimmer control circuit 100 according to an embodiment of the present invention, which is capable to detect whether a phase-cut dimmer is connected. Such a dimmer control circuit 100 comprises at least a phase-cut detecting unit 20, a switching unit 30, a dimmer control logic 40, at least two input terminals DCI, MDL, and an output terminal OUT.

Referring to FIG. 4, the switching unit 30 together with the dimmer control logic 40 will act as the multiplexer (MUX), the phase-cut detecting unit 20 will act as the comparator and the output terminal OUT will correspond to the output terminal of the multiplexer (MUX).

In order to increase the dimming range and improve the linearity of the corresponding dimming curve, i.e. the dimmer control curve, the dimmer control circuit 100 may further comprise a level shifting down unit 10 as it is depicted in FIG. 6. The level shifting down unit 10 can be supplied at the input terminal DCI by the dimmer control input voltage (VDCI), which is an average signal obtained by processing the mains voltage in such a manner that it is rectified, e.g. using a full-wave bridge, attenuated, e.g. using a resistive voltage divider, and then integrated, e.g. using a low-pass filter. The level shifting down unit 10 acts as a converter by shifting down the level of the average signal VDCI to a level shifted value VDCI_ls corresponding to the voltage derived from VDCI. The level shifted value VDCI_ls, which is issued by the level shifting down unit 10 at its output terminal LS, can be obtained by subtracting the average signal VDCI from a reference value VDCI_ref provided by a voltage DC source 11 inside the dimmer control circuit 100, which can be chosen in such a manner that the corresponding dimming curve is adjusted after level shifting to the actual phase-cut range δ of the phase-cut dimmers, i.e. from 0° until 120°.

It is to be noted that in the case that the dimmer control circuit 100 does not comprise the level shifting down unit 10, the input terminal DCI will be then directly coupled to the output terminal LS.

The phase-cut detecting unit 20, which acts as a comparator, compares an input value Vin+ at a terminal IN+ to another input value Vin− at a terminal IN−. The input value Vin− can be a reference value Vdim_th corresponding to the dimming threshold and provided by a voltage DC source 21 inside the dimmer control circuit 100. The terminal IN+ can be connected to the terminal LS and the input value Vin+ can be equal to the level shifted value VDCI_ls at the terminal LS within a range from a maximum value V100% corresponding to a maximum light output of the lamp, i.e. a light source, under control to a minimum value VMDL corresponding to a minimum light output of the lamp under control. The maximum value V100% can be a reference value provided by a voltage DC source 22 connected to the terminal IN+ through a diode D100%. The diode D100% will act as a short-circuit as soon as the level shifted value VDCI_ls becomes greater than the maximum value V 100%, thereby setting the maximum value of the input value Vin+ and the level shifted value VDCI_ls to the maximum value V100% and preventing the maximum light output from increasing in case that the AC mains supply delivers a voltage rising above 230 Vrms. The minimum value VMDL can be an externally adjustable reference value provided by an adjustable voltage DC source 23 external to the dimmer control circuit 100 and connected to the terminal MDL, which is connected to the terminal IN+ through a diode DMDL. The diode DMDL will act as a short-circuit as soon as the level shifted value VDCI is becomes lower than the minimum value VMDL, thereby setting the minimum value of the input value Vin+ and the level shifted value VDCI_ls to the minimum value VMDL and allowing the deepest dimming level of the lamp under control to be configurable. At the output of the phase-cut detecting unit 20, the comparison result between the input values Vin+ and Vin− can be used for controlling the state diagram, i.e. selecting the step dimming mode (STD) or the phase-cut dimming mode (PCD), of the dimmer control logic 40, as it is described in FIGS. 2-4. The dimmer control circuit 100 can be part of a lamp controller controlling the lamp under consideration. If the dimmer control logic 40 is in the step dimming mode (STD) (STD-1, STD-2, STD-3 and STD-4 states) and a connected phase-cut dimmer is tuned towards deeper dimming levels such that VDCI_ls is lower than the dimming threshold Vdim_th, the dimmer control logic 40 will automatically switch to the phase-cut dimming mode (PCD), thereby prioritizing phase-cut dimming above step dimming and allowing the end user to set a more precise level of light. Where the connected phase-cut dimmer is then tuned towards higher dimming levels such that VDCI_ls is greater than the dimming threshold Vdim_th, the connected phase-cut dimmer is thus set close to its maximum output, a reset (STD_RS) of the step dimming state machine is initiated, and the step dimming mode is activated. If the user subsequently toggles, i.e. switching OFF-ON several times, the mains (STD_T or STD_TOGGLE), the level of the STD state being determined by the number of mains toggles, as it is described in connection with FIGS. 2 and 3.

The switching unit 30 can connect, through a plurality of switches, the output terminal OUT of the dimmer control circuit 100 to one amongst several values, for example four values V1-V4 as it is illustrated in FIG. 6. The switching sequence of these switches can be controlled by the dimmer control logic 40 according its state diagram and through respective logic signals QA and QB, whose value 0 or 1 indicates their position. In our illustrative case of FIG. 6, the output terminal OUT is connected to V1 when QA=0 and QB=0, which corresponds to the reset of the dimmer control logic 40 to the PCD state, to V2 when QA=1 and QB=0, to V3 when QA=0 and QB=1, and to V4 when QA=1 and QB=1. The signals QA and QB are determined by the step dimming state machine (FIG. 3) when the step dimming mode (FIG. 2) is activated. However, when the phase cut dimming mode (PCD) is activated (FIG. 2), the signals QA and QB are fixed to QA=0 and QB=0, resulting in the output terminal OUT being connected to V1. According to an embodiment of the present invention, the values V2-V3 can be fixed at a mains voltage independent level, the value V4 can be externally adjustable and at a mains voltage independent level, and the value V1 can be depending on the mains voltage and application adjustable, e.g. V1 ranging between VMDL and V100%. Thus, the value V4 can be the minimum value VMDL, the value V1 can be the level at the terminal LS, i.e. in our illustrative case of FIG. 6, the level shifted value VDCI is within a range from the maximum value V100% to the minimum value VMDL, whereas the other values V2-V3 can correspond to an intermediate level of the light output of the lamp under consideration, e.g. to 50% for V2 and 25% for V3.

In the present invention, the state diagram of the dimmer control logic 40 can be shown in FIGS. 3 and 4, wherein, at start-up, the dimmer logic control 40 is initiated (I) in the PCD state. Such a state diagram shows that the step dimming levels can be defined by V2, V3, V4 and V1, V1 being also the phase-cut dimming level at the terminal LS when VDCI_ls is above the dimming threshold Vdim_th. Thus, the active 100% step dimming shares the same level V1 as the phase-cut dimming when the level at the terminal LS is greater than Vdim_th, which allows the dimming range of phase-cut dimmers to be not reduced by the threshold introduced by Vdim_th and under which phase-cut dimming is active. In other terms, the light output level can change when the dimming threshold Vdim_th is exceeded, which prevents reducing the dimming range of the phase-cut dimmer, unlike the case that the 100% step dimming level is fixed at a mains voltage independent level and in which the dimming range of the phase-cut dimmer is reduced because there is no change in light output anymore when Vdim_th is exceeded.

Some form of hysteresis is required in the detection of mains toggles to avoid false or undesired sequence of step dimming state transitions. In case lamp operation consists of multiple states, a mains toggle can be triggered by a drop in supply voltage and subsequent re-entrance of the normal operating state (NOS). The comparator of the phase-cut detecting unit 20 is however required to have hysteresis equal to at least the integrated (or filtered) mains ripple, in order to avoid undesired triggering and state transitions in the step dimming state machine.

Figure 7:
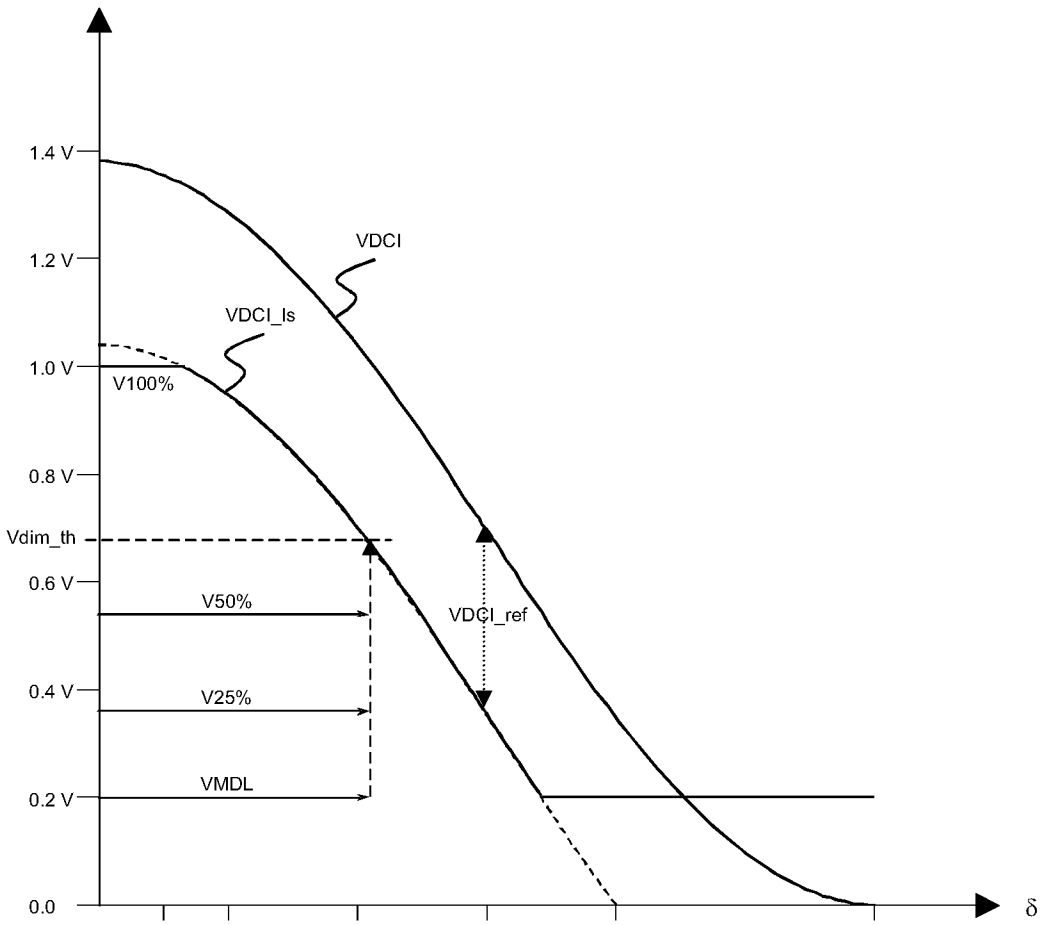
FIG. 7 shows a graph depicting the dimming curve generated by the dimmer control circuit 100, in the illustrative case that Vdim_th=0.65 V, V100%=1 V, VMDL=0.2 V, VDCI_ref=0.32 V.

FIG. 7 depicts the dimming curve generated by the dimmer control circuit 100, which shows the average signal VDCI (upper trace) and the level shifted value VDCI_ls (lower trace) versus phase-cut range δ, in the illustrative case that Vdim_th=0.65 V, V100%=1 V, VMDL=0.2 V, VDCI_ref=0.32 V. As it can be seen, the dimming curve exhibits two plateaus. The bottom plateau is set at the minimum value VMDL corresponding to the minimum light output of the lamp under control, while the top plateau is set at the maximum value V100% corresponding to the maximum light output of the lamp under control.

Applications contemplated for such dimmer control circuit 100 include dimmable lighting applications related to the combination of step dimming and phase-cut dimming, and in particular the control of dimmable lamps, such as compact fluorescent lamp (CFL), tube lamp (TL), high intensity discharge lighting (HID), and solid state lighting (SSL) for example.

In summary, a dimmer control circuit 100 capable to detect whether a phase-cut dimmer is connected using an average signal VDCI derived from the mains voltage has been described. The average signal VDCI or a signal VDCI_ls derived from VDCI, ranging from a minimum value to a maximum value, is compared to a dimming threshold Vdim_th through a phase-cut detecting unit 20. The comparison result is used to control the state diagram of a dimmer control logic 40 by selecting the step dimming mode (STD) or the phase-cut dimming mode (PCD). The output (OUT) of a switching unit 30 is determined by the state diagram of the dimmer control logic 40 in such a manner that the phase-cut dimming mode (PCD) is prioritized above the step dimming mode (STD) by switching from a STD state to the PCD state when the connected phase-cut dimmer is tuned towards deep dimming levels below the dimming threshold Vdim_th, and in such a manner that the maximum level of the STD states is depending on the mains voltage and application adjustable by being at the same level as that of the PCD mode when the connected phase-cut dimmer is tuned towards high dimming levels above the dimming threshold Vdim_th.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single or other unit may fulfil the functions of several items recited in the claims. The mere fact that certain measures are recited in mutually different dependent claims does not indicate that a combination of these measured cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A dimmer control circuit comprising:

a dimmer control logic;

a comparator (20) for comparing a signal derived from a mains voltage to a reference value, a comparison result being used for selecting between a step dimming mode and a phase-cut dimming mode of said dimmer control logic;

a switching unit, a switching sequence of said switching unit being controlled by said dimmer control logic based on the selection in order to switch between one amongst a plurality of values;

wherein, said phase-cut dimming mode is prioritized above said step dimming mode when a phase-cut dimmer is connected; and a maximum level of said step dimming mode is dependent upon said mains voltage and is application adjustable.

2. The circuit according to claim 1, wherein said dimmer control logic will switch from said step dimming mode to said phase-cut dimming mode when said signal is lower than said reference value.

3. The circuit according to claim 2, wherein the switch of said dimmer control logic from any step dimming state below maximum to said phase-cut dimming state is performed after initiating a reset of said dimmer control logic.

4. The circuit according to claim 3, wherein said reset is initiated when said signal becomes greater than said reference value under which said signal has dropped earlier.

5. The circuit according to claim 3, wherein said reset will occur in a normal operating state.

6. The circuit according to claim 1, wherein said dimmer control logic will switch between a plurality of step dimming states of said step dimming mode by toggling the mains voltage when said signal is greater than said reference value.

7. The circuit according to claim 1, wherein said maximum level of said step dimming mode is equal to the level of said phase-cut dimming mode when said signal is greater than said reference value.

8. The circuit according to claim 1, wherein said dimmer control circuit further comprises a converter, said signal being a signal converted by said converter.

9. The circuit according to claim 8, wherein said converter is a level shifting down unit.

10. The circuit according to claim 1, wherein said signal is an average signal.

11. The circuit according to claim 10, wherein said average signal is obtained by rectifying, attenuating, and integrating said mains voltage.

12. The circuit according to claim 1, wherein said switching unit and said dimmer control logic are part of a multiplexer.

13. A control circuit for controlling a lamp, said control circuit comprising:

a dimmer control circuit as claimed in claim 1.

14. The control circuit according to claim 13, wherein said plurality of values is used to set a light level of the lamp under control.

15. The control circuit according to claim 13, wherein the lamp under control is one of a compact fluorescent lamp, a tube lamp, a high intensity discharge lighting, or a solid state lighting.

16. An integrated circuit comprising a control circuit as claimed in claim 13.

17. An integrated circuit comprising a dimmer control circuit as claimed in claim 1.

18. A method of auto-detecting between a step dimming mode and a phase-cut dimming mode, said method comprising:

comparing a signal derived from a mains voltage to a reference value;

selecting between the step dimming mode and the phase-cut dimming mode of a dimmer control logic based on a comparison result;

controlling a switching unit by said dimmer control logic based on the selection in order to switch between one amongst a plurality of values;

wherein, said phase-cut dimming mode is prioritized above said step dimming mode when a phase-cut dimmer is connected; and a maximum level of said step dimming mode is dependent upon said mains voltage and application adjustable.

19. Computer program comprising program code for causing a computer to carry out the method as claimed in claim 18 when said computer program is carried out on a computer.

* * * * *